US006227257B1

(12) United States Patent
Griffiths

(10) Patent No.: US 6,227,257 B1
(45) **Date of Patent: *May 8, 2001**

(54) FABRICS

(75) Inventor: Paul Philip Griffiths, Mountsorrel (GB)

(73) Assignee: M. Wright & Sons Ltd. (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/165,400

(22) Filed: Oct. 2, 1998

(30) Foreign Application Priority Data

Oct. 3, 1997 (GB) ..... 9720927

(51) Int. Cl.[7] ..... D03D 11/00

(52) U.S. Cl. ..... 139/408; 139/11; 139/DIG. 1; 139/409; 139/410

(58) Field of Search ..... 2/8, 412, 2.5; 139/11, 139/DIG. 1; 428/192

(56) References Cited

U.S. PATENT DOCUMENTS

| | | | | |
|---|---|---|---|---|
| 3,834,424 | * | 9/1974 | Fukuto et al. | 139/11 |
| 4,699,567 | | 10/1987 | Stewart . | |
| 4,842,923 | * | 6/1989 | Hartman | 428/219 |
| 5,085,252 | * | 2/1992 | Mohamed et al. | 139/11 |
| 5,102,725 | | 4/1992 | Knox et al. . | |
| 5,788,907 | * | 8/1998 | Brown, Jr. et al. | 263/280 |
| 5,857,215 | * | 1/1999 | Fergason et al. | 2/8 |
| 5,876,834 | * | 3/1999 | Foy et al. | 428/192 |

FOREIGN PATENT DOCUMENTS

| | | |
|---|---|---|
| 296 09 274 U | 10/1987 | (DE) . |
| 94 17 517 | 12/1994 | (DE) . |
| 296 11 356 U | 9/1996 | (DE) . |
| 0 569 849 A1 | 11/1993 | (EP) . |

* cited by examiner

*Primary Examiner*—John J. Calvert
*Assistant Examiner*—Robert Muromoto, Jr.
(74) *Attorney, Agent, or Firm*—Nikolai, Mersereau & Dietz, P.A.

(57) ABSTRACT

The invention relates to a fabric (10) for arresting ballistic articles, the fabric (10) comprising first (11) and second (12) woven layers secured together. The working fibers of the first (11) and second (12) layers are of substantially inextensible yarns such as aramid fibers. The working fibers of the first layer (11) are perpendicular to the working fibers of the second layer (12).

27 Claims, 2 Drawing Sheets

FABRICS

BACKGROUND OF THE INVENTION

This invention concerns improvements in or relating to fabrics, in particular fabrics having physical characteristics suitable for arresting ballistic articles. Such articles typically include fragments of compressor fan blades from aircraft engines such as turbofans. However, the term 'ballistic article' is also intended to embrace eg; bullets and shells, or fragments thereof.

It has for some years been common practice for manufacturers of aircraft engines having rotating parts to provide within the engine a barrier capable of arresting ballistic articles arising from mechanical failure within the engine. The object of this practice is to minimise the damage to the remainder of the engine that may be caused by such articles.

In the early days of aviation, such barriers were provided by rigid, metal components. However, these are of limited utility because of the tendency of metal barriers to transmit impulses directly to other parts of the engine, thereby causing potentially catastrophic damage.

The development of aramid fibres led to replacement of the rigid barriers by barriers comprised essentially of woven fabrics made of aramid yarns. Typically, the woven fabrics are produced in widths of up to 1000 mm that are wrapped several times about an annular frame defining eg the periphery of the compressor stage of a turbofan engine. The thus-wound fabric is effectively exposed, on the inner face of the barrier, to the exterior of the compressor stage, so that high velocity articles resulting from mechanical failure within the compressor stage tend to be thrown outwardly into the fabric wrap. The fabric absorbs the resulting impulse.

This method of arresting ballistic articles is successful because aramid fibres possess almost no elasticity yet are flexible and have extremely good tensile strength characteristics. Typically, the elongation to failure of an aramid fibre is less than 3%, yet the fibre can withstand huge tensile loads before such failure occurs. Thus, a woven fabric consisting of aramid fibres is most unlikely to rupture when it experiences the impulse from a ballistic article in an aircraft engine; yet the energy of such an impulse is successfully absorbed by the woven fabric structure without any significant part of the energy being transferred to the remainder of the engine components.

In this way, woven aramid fibre barriers have prevented many instances of catastrophic aircraft engine failure.

The high strength/low elasticity characteristics of aramid fibres also make them highly suitable as ballistic barriers in eg; flak jackets and bullet-proof vests.

In view of their characteristics, fabrics woven from aramid fibres are known as 'rigid fabrics'. There are other fibres (including high-density polypropylene and polyethylene) that are also potentially suitable in such applications. The weaving of such alternative fibres also results in so-called rigid fabrics. The term "rigid fabric" also embraces fabrics made from mixes of fibres, not all of which need necessarily possess low elasticity/high strength characteristics.

Tests have revealed that in typical instances of aircraft engine component failure, known rigid fabric barriers exhibit extensions significantly greater than the approximately 3% figure mentioned above. The precise performance characteristics depend in part on the engine in which the fabric is installed.

There is a constant effort to improve the efficiency of aircraft engines, by reducing their specific fuel consumption characteristics. One way of achieving this is to increase the compressor fan area, thereby permitting a higher charge compression ratio to be used. However, for reasons of weight saving and because it is often not possible simply to increase the overall dimensions of an engine, such increases in fan area are usually accomplished at the expense of reducing the size of other components constituting the generally annular shape of the compressor chamber. Thus there is a need for a rigid fabric that offers comparable performance to previous rigid fabrics, whilst occupying a reduced volume and/or possessing reduced mass.

It is known from U.S. Pat. No. 4,699,567 to produce a ballistic barrier for an aircraft turbofan engine in the form of a fabric wrap comprising a plurality of squares of woven, rigid fabric. The squares are secured together in a series, by means of low strength stitching threads, for example cotton, to create an elongate fabric that is wrapped around the compressor stage of the turbofan engine during its construction.

The size of the squares is chosen so that when a length of the fabric is wrapped several times around the compressor stage, the joints between squares in the layers of fabric are out of phase with one another so that there are no radial lines of weakness in the fabric wrap.

The wrap is applied under low or zero tension. When a ballistic article such as a blade tip strikes the wrap, the joints between adjacent squares in the vicinity of the impact fail in a progressive and controlled manner, thereby absorbing the energy of the ballistic article. Thus the fabric of U.S. Pat. No. 4,699,567 damps the initially high frequency oscillation of the ballistic article in a short period.

However, the fabric wrap of U.S. Pat. No. 4,699,567 is complex and time consuming the manufacture, partly because of the need to produce numerous discrete squares of rigid fabric; and partly because of the need subsequently to stitch the squares together using a blanket stitch in yarn or low strength thread such as cotton. Such stitching has to be carried out as a separate step from the weaving of the squares.

SUMMARY OF THE INVENTION

According to a first aspect of the invention, there is provided a fabric for arresting ballistic articles comprising first and second woven layers secured together, the first layer including a plurality of substantially inextensible, first working fibres extending generally parallel to one another and the second layer including a plurality of substantially inextensible, second working fibres extending generally parallel to one another and generally perpendicular to the first working fibres.

This arrangement advantageously provides working fibres in mutually orthogonal directions in a single fabric that can be continuously woven in virtually any length. Thus the fabric of the invention overcomes the disadvantages of the fabric of U.S. Pat. No. 4,699,567.

In a second aspect, the invention resides in a fabric comprising first and second, substantially parallel, woven layers secured together by a plurality of binder threads, whereby the deflection characteristic of the fabric is controllable in dependence on the positioning and/or density of the said binder threads.

The density and positioning of the binder threads determines firstly the length of each floater yarn (ie. an exposed, working yarn); and secondly the degree of bonding between the parallel woven layers constituting the fabric.

As In contrast to the fabric of U.S. Pat. No. 4,699,567, the fabric of the invention is believed to function by transferring the energy of an impacting ballistic article about an annulus defined by the wrap of the fabric about the compressor stage. Thus it is believed that the energy of the impacting, ballistic article decays as its energy is absorbed in the length of the fabric wrap. This technique is believed to result in lesser damage to the fabric wrap in the event of a ballistic impact than occurs in the case of the stitched squares of U.S. Pat. No. 4,699,567.

Preferably the working fibres of the first layer are weft fibres, and the working fibres of the second layer are warp fibres. The fabric of the invention may include one or more of the following:

a single weft sateen;

a double weft sateen;

a warp sateen;

a double warp sateen.

In particularly preferred embodiments, one layer of the fabric is a weft sateen (particularly a double weft sateen) and the other layer is warp sateen (particularly a single or double warp sateen). This construction conveniently permits the continuous weaving of the fabric.

Preferably the layers are secured together by means of a binder yarn. In preferred embodiments the binder yarn is substantially inextensible. If the binder yarn is of the same material as the remainder of the fabric, it can be introduced substantially simultaneously with the weaving of the fabric.

Preferably the first and second layers of the fabric are substantially integral with one another at opposed edges of the fabric. This feature confers strength on the fabric.

Preferably the working fibres are aramid fibres. It is also preferable that the binder yarn is an aramid fibre, and preferably the same aramid fibre as the working fibres.

In particularly preferred embodiments, all components of the fabric are of the same aramid fibre, depending on the type of loom used for manufacture of the fabric.

According to a third aspect of the invention there is provided a method of manufacturing a fabric comprising the steps of:

weaving first and second layers; and securing the said layers together generally parallel to one another, wherein the first layer includes substantially inextensible working fibres extending parallel to one another in a first direction; and the second layer includes substantially inextensible working fibres extending generally parallel to one another in a second direction.

This method advantageously may be used to produce a fabric according to the invention.

Conveniently the first and second layers are woven substantially simultaneously.

Preferably the first layer is a weft sateen (in particular a double weft sateen); and the second layer is a warp sateen (in particular a single or double warp sateen as desired).

Conveniently the first and second layers are substantially continuous along opposed edges of the fabric. This permits the continuous weaving of the fabric according to the method of the invention.

Conveniently the working fibres of the fabric are or include aramid fibres.

The method optionally includes weaving of one or more substantially inextendable binder threads securing the first and second layers together. The or each binder thread preferably is or includes an aramid yarn.

The advantages of the foregoing features in the method of the invention are comparable to the equivalent advantages concerning the fabric defined hereinabove.

According to a fourth aspect of the invention, there is provided a ballistic barrier including a fabric as defined hereinabove or manufactured according to the method defined hereinabove.

The invention is also considered to reside in a turbofan engine including a ballistic barrier as defined herein.

According to a sixth aspect of the invention, there is provided a turbofan engine including a fabric as defined herein or manufactured according to the method defined herein encircling the compression stage of the engine at generally negligible tension, the fabric defining a ballistic barrier for the turbofan of the engine.

According to an seventh aspect of the invention, there is provided use of aramid working fibres in the manufacture of a multi layer, woven, rigid fabric.

According to the eighth aspect of the invention, there is provided the use of aramid binder threads in the manufacture of a multi layer, woven, rigid fabric.

DESCRIPTION OF PREFERRED EMBODIMENTS

Figure 1:
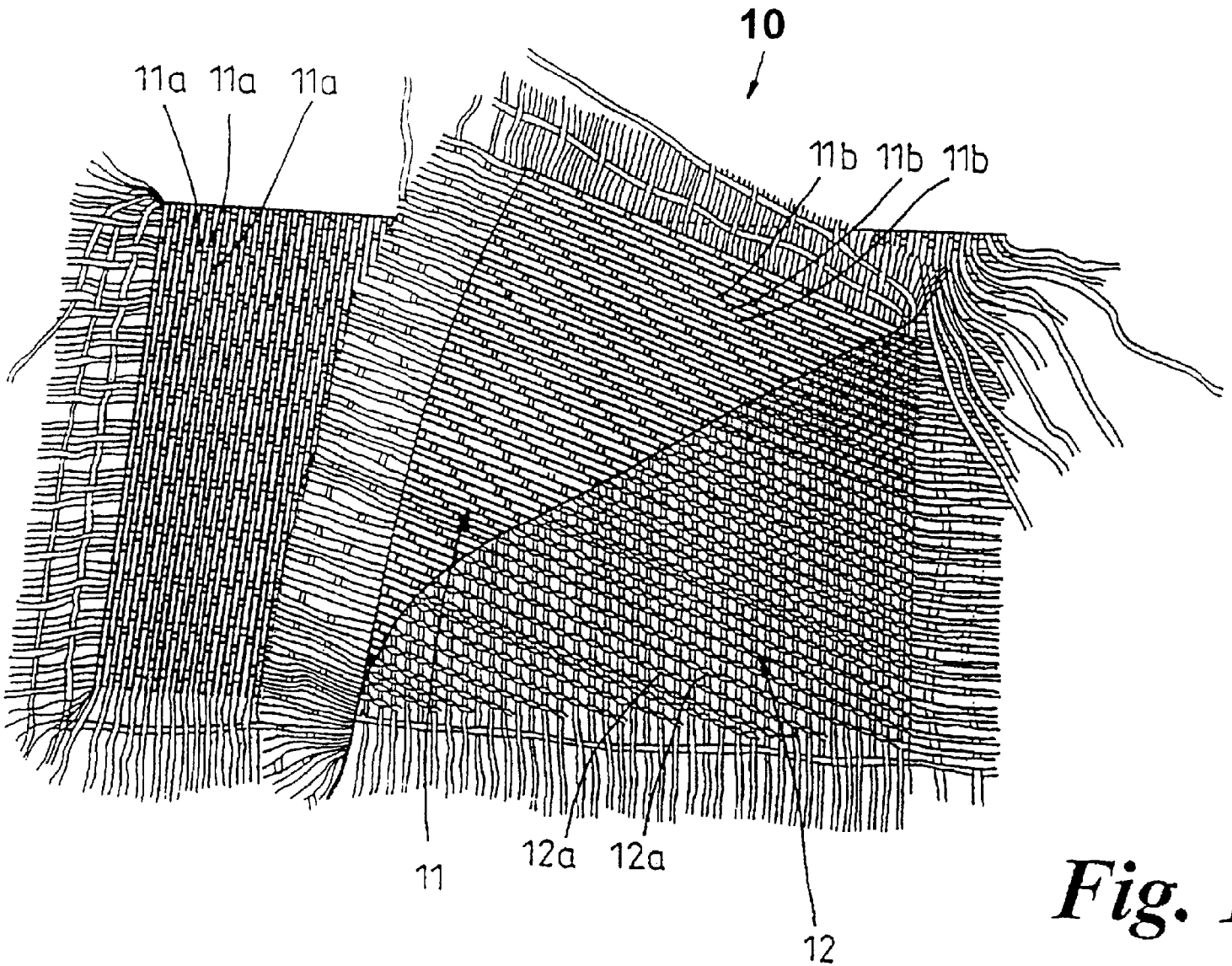
FIG. 1 is a perspective view of a partly dismantled fabric according to the invention.

Referring to the drawing figures, there is shown in FIG. 1 a sample of fabric according to the invention, showing the principles of its construction.

In FIG. 1 the fabric 10 comprises first 11 and second 12 layers of fabric each woven from a substantially inextensible yarn such as Kevlar brand fibre manufactured by Du Pont Engineered Fibres, PO Box 50, CH 1218, Le Grand-Saconnex, Geneva, Switzerland.

First layer 11 is a double weft sateen the working (weft) fibres 1 lb of which are shown in exemplary fashion on the top face of layer 11

Since layer 11 is a double weft construction, its inner face (shown folded back in FIG. 1) also possesses working weft fibres of substantially inextendable character.

Second layer 12 is a single warp sateen, the working warp fibres 12*a* of which extend substantially perpendicular to the weft floaters of upper layer 11.

A binder yarn (not visible in FIG. 1) in the form of a warp thread interconnecting layers 11 and 12 secures the two layers together. In practice the binder warp threads are distributed along the weft direction of the fabric, whereby the layers are secured together at a great number of substantially evenly distributed points.

As is well known in the art, a sateen is a weave in which the pattern of floaters (that give the outer face of the sateen its appearance) is substantially randomised or at least pseudorandomised, in order to provide a variable distribution of floaters.

The density and positioning of the binder yarns also influences the degree of exposure of the floaters, and hence their lengths. It will thus be appreciated that the deflection characteristic of the fabric of FIG. 1 may be controlled, by virtue of the spacing of the binder yarns in the warp direction and the concentration of their interloopings with the layers 11, 12 in the weft direction.

Figure 2:
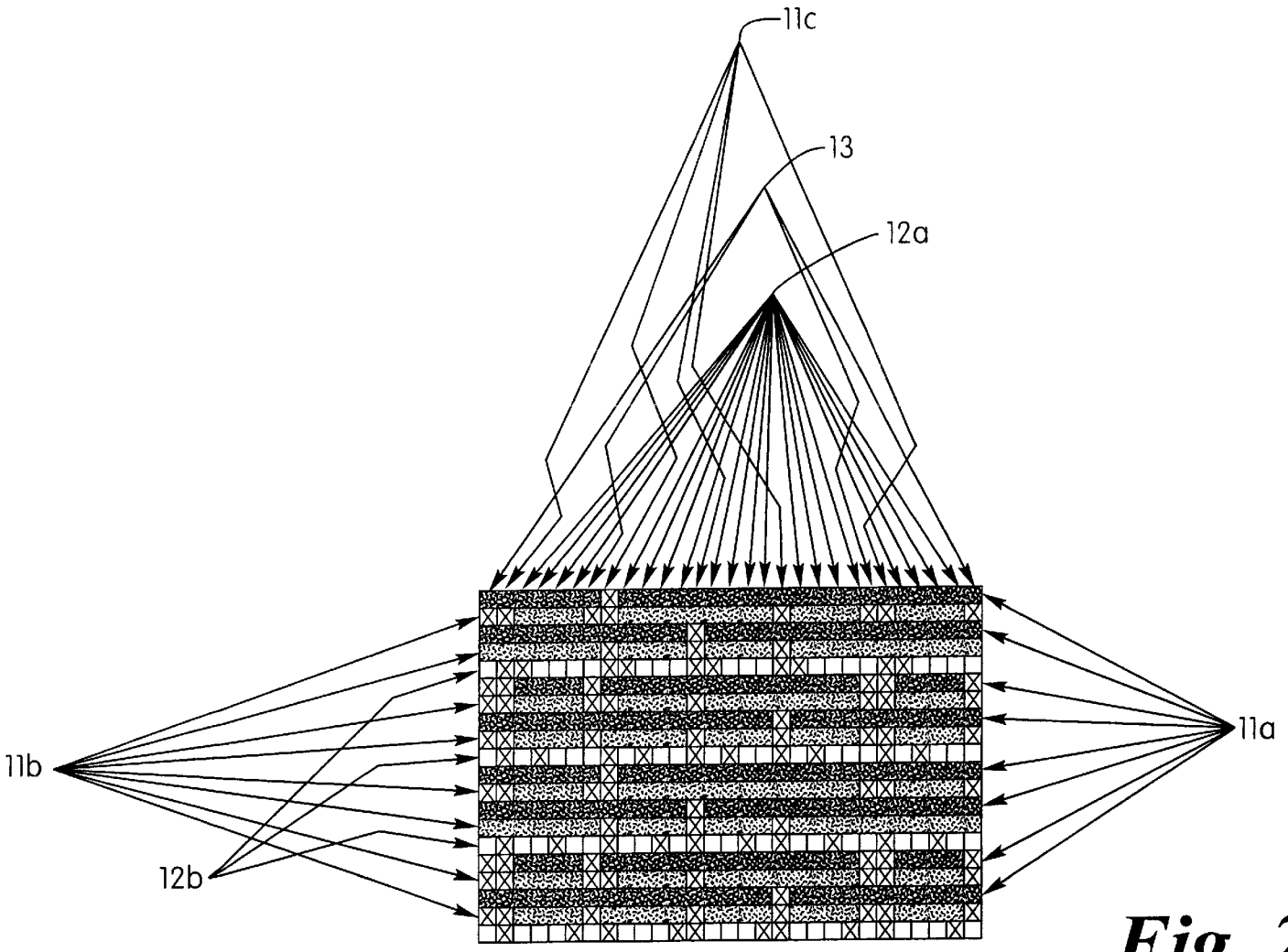
FIG. 2 is a schematic representation of the FIG. 1 fabric in its assembled condition.

Referring now to FIG. 2, the fabric of FIG. 1 is shown using a graph paper notation conventional in the textile industry.

The weft fibres 11*a* of the top face of layer 11, the weft fibres 11*b* of the inner face of top layer 11, the warp fibres 11*c* of top face 11, the warp fibres 12*a* of the layer 12 and the weft fibres 12*b* of the layer 12 are all visible in FIG. 2. Also shown is the presence of binder warp 13.

Although the invention has been described in relation to upper layer 11 being formed as a double weft sateen and lower layer 12 as a warp sateen, other combinations are possible. For example, upper layer 11 may be a single weft sateen, or a double or single warp sateen; and layer 12 may be a double warp sateen, or a double or single weft sateen. The important requirement is to provide in each of the layers 11, 12 floaters (the lengths of which are adjustable by means of the positioning and density of the binder threads 13) that act as working fibres in the fabric and extend in mutually orthogonal directions when the fabric is assembled by means of the binder threads 13.

The preferred method of manufacturing the fabric includes continuously weaving layers 11 and 12, and substantially simultaneously applying binder yarn 13 in such a way as to secure the layers 11, 12 together as aforesaid.

The preferred weaving method involves tubular weaving of the layers 11, 12 so that opposed edges of the layers 11, 12 in eg. the warp direction are secured together.

The result is a rigid fabric of lower elongation (eg. a maximum elongation in the range 5 to 8%) than prior art fabrics. Since the fabric possesses working fibres extending in orthogonal directions in the respective layers 11, 12, its ability to arrest ballistic articles is extremely good.

An aircraft turbofan engine having a length of the fabric according to the invention wrapped around its compressor stage at zero tension or substantially zero tension is believed to exhibit extremely good blade tip arrestation characteristics. It is believed that the fabric so secured has a tendency to distribute the energy from the impact of a ballistic article about the annulus of the wrap. The annulus oscillates for a short period following the impact, during which time all energy of the impact is dissipated and the blade tip is arrested without penetrating or substantially tearing the rigid fabric of the invention.

What is claimed is:

1. A fabric for arresting ballistic articles comprising self-sustaining first and second separate woven layers of fabric secured together by at least one, independent, substantially inextensible, binder fibre, the first layer including a plurality of substantially inextensible, first working fibres extending generally parallel to one another and the second layer including a plurality of substantially inextensible, second working fibres generally parallel to one another and generally perpendicular to the first working fibres, such that the substantially inextensible fibres in the first layer, the second layer and the binder are separate fibres to provide greater integrity and force absorbing capacity to the fabric.

2. A fabric according to claim 1, comprising first and second, substantially parallel, woven layers secured together by a plurality of binder threads, whereby the deflection characteristic of the fabric is controllable in dependence on the positioning and/or density of the said binder threads.

3. A fabric according to claim 1 wherein the working fibres of the first layer are weft fibres and the working fibres of the second layer are warp fibres.

4. A fabric according to claim 1 wherein one of the layers is a single weft sateen.

5. A fabric according to claim 1 wherein one of the layers is a double weft sateen.

6. A fabric according to claim 1 wherein one of the layers is a warp sateen.

7. A fabric according to claim 1 wherein one of the layers is a double warp sateen.

8. A fabric according to claim 1 wherein one layer is a double weft sateen and the other layer is a single warp sateen.

9. A fabric according to claim 2 wherein the binder yarn is substantially inextensible.

10. A fabric according to claim 1 including a binder yarn securing the first and second layers together.

11. A fabric according to claim 2 wherein the first and second layers are substantially integral with one another at opposed edges of the fabric.

12. A fabric according to claim 1, wherein the working fibres are aramid fibres.

13. A fabric according to claim 2, wherein the binder yarn is an aramid fibre.

14. A fabric according to claim 1 woven entirely from aramid fibres.

15. A method of manufacturing a fabric comprising the steps of:

weaving self-sustaining separate first and second layers of fabric; and securing the said self-sustaining layers together generally parallel to one another, by at least one, independent, substantially inextensible, binder fibre, wherein the first layer includes substantially inextensible working fibres extending parallel to one another in a first direction; and the second layer includes substantially inextensible working fibres extending generally parallel to one another in a second direction, such that the substantially inextensible fibres in the first layer, the second layer and the binder are separate fibres to provide greater integrity and force absorbing capacity to the fabric.

16. A method according to claim 15 wherein the first and second layers are woven substantially simultaneously.

17. A method according to claim 15 wherein the first layer is a weft sateen and the second layer is a warp sateen.

18. A method according to claim 15 wherein the first layer is a weft sateen and the second layer is a warp sateen, and the weft sateen is a double weft sateen.

19. A method according to claim 15 wherein the first layer is a weft sateen and the second layer is a warp sateen, and the warp sateen is a double warp sateen.

20. A method according to claim 15 wherein the first layer is a weft sateen and the second layer is a warp sateen; the weft sateen is a double weft sateen; and the warp sateen is a double warp sateen.

21. A method according to claim 15 wherein the first and second layers are substantially continuous along opposed edges of the fabric.

22. A method according to claim 15 wherein the working fibres are or include aramid fibres.

23. A method according to claim 15 wherein the first and second layers are secured together by means of one or more substantially inextensible binder threads.

24. A method according to claim 15 wherein the first and second layers are secured together by means of one or more substantially inextensible binder threads, and the or each binder thread is or includes an aramid yarn.

25. A method according to claim 15 including the step of modifying the deflection characteristic of the fabric by altering the density and/or position of binder yarns securing the said layers together.

26. A fabric for arresting ballistic articles according to claim 1 wherein the fabric is formed into a cylinder shape and encircles a turbofan engine, the fabric having selvage at the for and aft ends of the cylinder to hold the fabric together.

27. A fabric for arresting ballistic articles according to claim 1 wherein one of the layers is a double warp sateen, and wherein the binder yarn is an aramid fibre.

* * * * *